US009919403B2

(12) United States Patent
Hamaura et al.

(10) Patent No.: US 9,919,403 B2
(45) Date of Patent: Mar. 20, 2018

(54) POLISHING APPARATUS, POLISHING PAD POSITIONING METHOD, AND POLISHING PAD

(71) Applicant: EBARA CORPORATION, Tokyo (JP)

(72) Inventors: Kaoru Hamaura, Tokyo (JP); Takeshi Sakurai, Tokyo (JP); Suguru Ogura, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/321,791

(22) Filed: Jul. 1, 2014

(65) Prior Publication Data

US 2015/0004886 A1 Jan. 1, 2015

(30) Foreign Application Priority Data

Jul. 1, 2013 (JP) ..... 2013-138033

(51) Int. Cl.

| | |
|---|---|
| ***B24B 37/34*** | (2012.01) |
| ***B24B 37/26*** | (2012.01) |
| ***B24B 37/20*** | (2012.01) |
| ***B24B 47/22*** | (2006.01) |

(52) U.S. Cl.

CPC ..... *B24B 37/34* (2013.01); *B24B 47/22* (2013.01); *Y10T 29/49826* (2015.01)

(58) Field of Classification Search

CPC ..... B24B 37/205; B24B 37/26; B24B 37/34; B24B 47/22; Y10T 29/49826

See application file for complete search history.

(56) References Cited

U.S. PATENT DOCUMENTS

| | | | | |
|---|---|---|---|---|
| 5,704,827 | A | 1/1998 | Nishi et al. | |
| 5,931,724 | A * | 8/1999 | Perlov | B24B 37/12 285/320 |
| 6,244,941 | B1 * | 6/2001 | Bowman | B24B 37/11 451/287 |
| 6,835,118 | B2 * | 12/2004 | Berkstresser | B24D 9/10 438/690 |
| 7,727,052 | B2 * | 6/2010 | Borucki | B24B 37/34 451/285 |

(Continued)

FOREIGN PATENT DOCUMENTS

| | | |
|---|---|---|
| JP | S62-081562 U | 5/1987 |
| JP | H08-118231 A | 5/1996 |

(Continued)

*Primary Examiner* — Marc Carlson
(74) *Attorney, Agent, or Firm* — Baker & Hostetler LLP

(57) ABSTRACT

When a polishing pad is attached to a polishing table, the polishing pad can be easily positioned on and attached to the polishing table and air pockets are prevented from forming. As a position guide member 130 is inserted into a guide hole 109 with an attachment surface of a polishing pad 108 downward, the polishing pad 108 is positioned on and attached to a polishing table 110. At this time, the guide hole 109 of the polishing pad 108 is guided by the position guide member 130 and the polishing pad 108 is easily positioned so as to match the upper surface of the polishing table 110 with the outer periphery thereof. Then, as release paper is gradually peeled off from a rear surface of the polishing pad 108, the portion where the release paper is peeled off is attached to the polishing table 110.

13 Claims, 6 Drawing Sheets

(56) References Cited

U.S. PATENT DOCUMENTS

| | | | | |
|---|---|---|---|---|
| 8,992,288 | B2 * | 3/2015 | Suzuki | B24B 37/22 451/285 |
| 2001/0031612 | A1 * | 10/2001 | Scott | B24B 37/16 451/65 |
| 2002/0042243 | A1 * | 4/2002 | Ihsikawa | B24B 37/013 451/6 |
| 2005/0009456 | A1 * | 1/2005 | Sasaki | B24B 37/245 451/287 |
| 2006/0240749 | A1 * | 10/2006 | Yun | B24B 37/26 451/41 |
| 2009/0124176 | A1 | 5/2009 | Borucki | |
| 2013/0029566 | A1 * | 1/2013 | Suzuki | B24B 37/22 451/177 |

FOREIGN PATENT DOCUMENTS

| | | | |
|---|---|---|---|
| JP | 2004-001160 | A | 1/2004 |
| JP | 2004-090106 | A | 3/2004 |
| JP | 2004-259814 | A | 9/2004 |
| JP | 2007-203394 | A | 8/2007 |
| JP | 2009-119592 | A | 6/2009 |

* cited by examiner

POLISHING APPARATUS, POLISHING PAD POSITIONING METHOD, AND POLISHING PAD

BACKGROUND OF THE INVENTION

In recent years, a polishing apparatus has been used to polish a surface of a substrate such as a semiconductor wafer. The polishing apparatus is configured to include: a polishing table onto which a polishing pad for polishing a substrate is positioned and attached; a motor rotating the polishing table; a top ring holding and pressing the substrate against the polishing pad; and the like.

When such a polishing apparatus polishes a large number of substrates, the polishing surface of a polishing pad is worn, and thus the polishing pad is replaced at regular intervals. The polishing pad is a consumable material having a high replacement frequency for the polishing apparatus, thus requiring high working efficiency for replacing polishing pads.

The polishing pad is replaced, for example, by hand of a worker. The polishing pad is commonly formed into the same shape as that of an attachment surface of the polishing table. Here positioning and attaching the polishing pad onto the polishing table in a state of being shifted with respect to the attachment surface of the polishing table may cause adverse effects on polishing performance. Therefore, the polishing pad is required to be positioned on and attached to the polishing table so as to match the attachment surface with the outer periphery. However, this work is visually carried out by workers, thereby causing a problem of increasing attachment time and reducing attachment productivity for inexperienced workers.

In light of this, there is known a polishing pad fixing mechanism for fixing a polishing pad to a platen (polishing table) in an easy manner and with a high accuracy, wherein the polishing pad is attached onto a support base having a guide ring for positioning the polishing pad, and the support base is fixed to the platen (see Japanese Patent Laid-Open No. 2004-259814).

By the way, in the polishing pad attachment process, air may enter between a front surface of the polishing table and a rear surface of the polishing pad, forming air pockets. Thereby, an air trapped portion of the polishing pad slightly rises with respect to the polishing table. The projected portion of the polishing pad may affect the substrate polishing process. Therefore, when air pockets are formed between the polishing pad and the polishing table, the polishing pad needs to be removed from the polishing table and discarded, and then a new polishing pad needs to be attached to the polishing table again. In light of this, in order to prevent air pockets from forming, the polishing pad is attached to the polishing table by pressing the polishing pad against the polishing table starting with one peripheral portion thereof, then gradually moving toward a central portion thereof, to extrude air pockets therefrom.

However, it is difficult to completely extrude air pockets before attaching the polishing pad to the polishing table. Note that a currently available wafer has a maximum diameter of 300 mm. It the wafer diameter increases in the future, the size of the polishing pad may increase accordingly. Such an increase in size of the polishing pad may make it more difficult for even experienced workers to attach the polishing pad to the polishing table without forming air pockets.

SUMMARY OF THE INVENTION

In an embodiment, an apparatus is used to polish a substrate. This apparatus includes a rotatable polishing table having a surface on which a polishing pad for polishing a substrate can be positioned, wherein the polishing table has a first attachment portion configured to allow a position guide member guiding the polishing pad to a predetermined position of the polishing table to be attached thereto and the first attachment portion is formed at a rotational center of the surface of the polishing table.

According to the embodiment, the position guide member is configured to be inserted into a hole provided in the polishing pad when the polishing pad is positioned.

According to the embodiment, the polishing table includes a second attachment portion for attaching a direction guide member guiding a direction of positioning the polishing pad, and the second attachment portion includes a hole for passing light emitted from a polishing end point detection device detecting a polishing end point of the substrate being polished.

According to the embodiment, the polishing table includes a third attachment portion for attaching a direction guide member guiding a direction of positioning the polishing pad, and the third attachment portion is provided on an outer peripheral edge of the polishing table.

According to the embodiment, the position guide member has a non-perfect-circular outer shape in plan view in a state of being attached to the first attachment portion.

According to the embodiment, the position guide member has a rotationally asymmetric outer shape in plan view in a state of being attached to the first attachment portion.

In another embodiment, a polishing pad positioning method includes: a step of attaching the position guide member to the first attachment portion; and a positioning step of positioning the polishing pad having a hole corresponding to the position guide member on the polishing table by inserting the position guide member into the hole corresponding to the position guide member.

According to the another embodiment, the polishing pad includes a hole corresponding to the position guide member and a hole corresponding to the direction guide member, the polishing pad positioning method including: a step of attaching the position guide member to the first attachment portion; a step of attaching the direction guide member to the second attachment portion; and a positioning step of positioning the polishing pad on the polishing table by inserting the position guide member into the hole corresponding to the position guide member and by inserting the direction guide member into the hole corresponding to the direction guide member.

According to the another embodiment, the polishing pad includes a hole corresponding to the position guide member and a hole corresponding to the direction guide member, the polishing pad positioning method including: a step of attaching the position guide member to the first attachment portion; a step of attaching the direction guide member to the third attachment portion; and a positioning step of positioning the polishing pad on the polishing table by inserting the position guide member into the hole corresponding to the position guide member and by inserting the direction guide member into the hole corresponding to the direction guide member.

In still another embodiment, a polishing pad is configured to be positionable on a rotatable polishing table and provided for polishing a substrate, wherein a hole is formed at a position corresponding to a rotational center of the polishing table.

According to the still another embodiment, there is formed a hole on the polishing pad for passing light emitted from a polishing end point detection device detecting a polishing end point of the substrate being polished.

According to the still another embodiment, a notched portion is formed in an outer edge portion thereof.

According to the still another embodiment, the hole formed at a position corresponding to the rotational center of the polishing table is configured to allow a lid body to be attached thereto.

According to the still another embodiment, the hole formed at a position corresponding to the rotational center of the polishing table has a non-perfect-circular outer periphery shape.

The present invention can easily position (arrange) a polishing pad on a polishing table and prevent air pockets from forming when the polishing pad is attached to the polishing table.

DETAILED DESCRIPTION OF THE PREFERRED EMBODIMENTS

Figure 1:
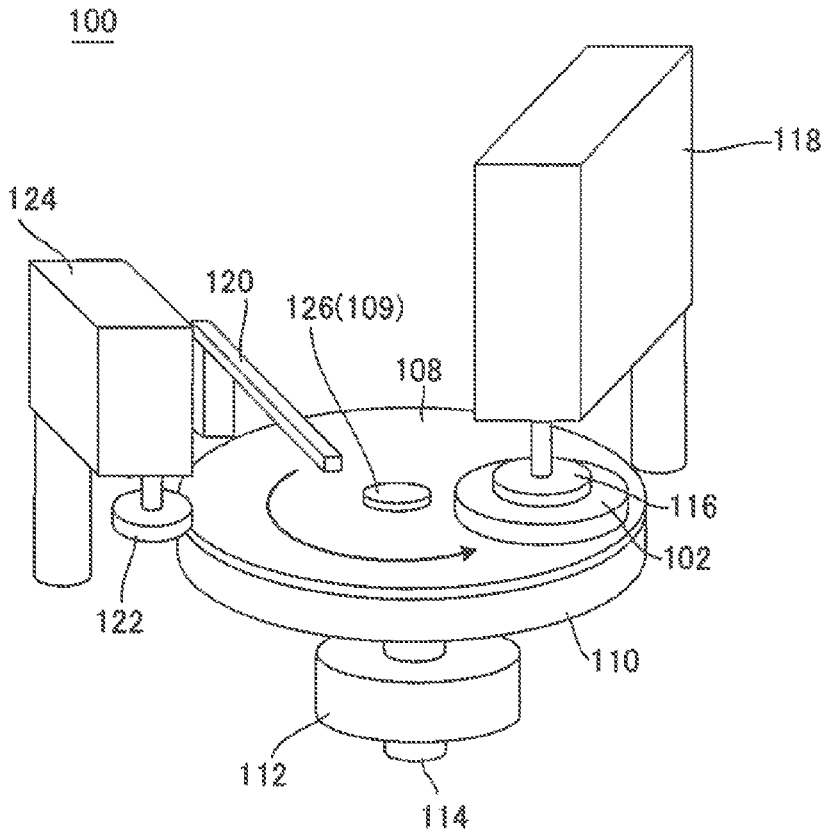
FIG. 1 is a schematic view illustrating an entire configuration of a polishing apparatus according to the present embodiment.

The present invention relates to a polishing apparatus, a polishing pad positioning method, and a polishing pad, allowing for easy positioning of the polishing pad.

There follows a description of a polishing apparatus, a polishing pad positioning method, and a polishing pad according to an embodiment of the present invention with reference to the accompanying drawings. Note that in the drawings to be described below, the same reference numerals or characters are assigned to the same or similar components, and the duplicate description is omitted. The following embodiment will describe a chemical mechanical polishing (CMP) apparatus as an example of the polishing apparatus, but the present invention is not limited to this.

FIG. 1 is a schematic view illustrating an entire configuration of the polishing apparatus according to the present embodiment. As illustrated in FIG. 1, a polishing apparatus 100 includes: a polishing table 110 capable of positioning, on an upper surface thereof, a polishing pad 108 for polishing a substrate 102 such as a semiconductor wafer; a table drive shaft 114 for rotationally driving the polishing table 110 in a circumferential direction of the shaft; a first electric motor 112 for driving the table drive shaft 114; a top ring 116 capable of holding the substrate 102; and a second electric motor 118 for rotationally driving the top ring 116.

The polishing apparatus 100 further includes a slurry line 120 supplying a polishing liquid including a polishing agent onto the upper surface of the polishing pad 108; and a dresser unit 124 having a dresser disk 122 performing conditioning (dressing) of the polishing pad 108.

Figure 2:
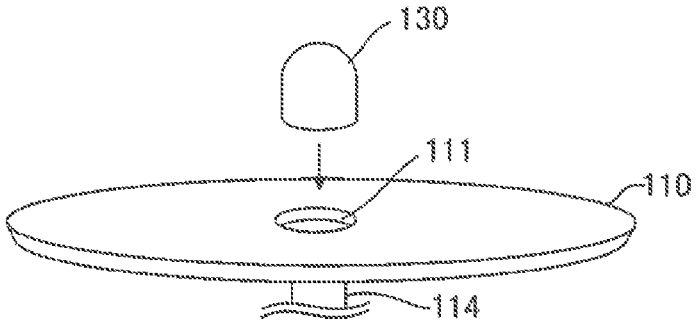
FIG. 2 is a schematic view describing a polishing table according to the present embodiment.

A guide hole 109 for inserting a position guide member 130 as illustrated in FIG. 2 to be described later is provided at a central portion of the polishing pad 108, namely, at a position corresponding to a rotational center of the polishing table 110. The guide hole 109 has a circular shape so as to correspond to an outer shape of the position guide member 130 (see FIG. 2). A lid 126 is fitted in the guide hole 109 so as to prevent a polishing liquid from entering the guide hole 109 when the substrate is polished.

When the substrate 102 is polished, the polishing liquid including a polishing agent is supplied onto the upper surface of the polishing pad 108 through the slurry line 120, and the polishing table 110 is rotationally driven by the first electric motor 112. Then, in a state in which the top ring 116 is rotated around a rotating shaft shifted from a rotating shaft of the polishing table 110, the substrate 102 held by the top ring 116 is pressed against the polishing pad 108. Thereby, the substrate 102 is polished and planarized by the polishing pad 108.

FIG. 2 is a schematic view describing the polishing table 110 illustrated in FIG. 1.

As illustrated in the figure, the polishing table 110 has a recessed portion 111 (first attachment portion) formed at a rotational center of the upper surface onto which the polishing pad 108 is positioned and attached. The recessed portion 111 is formed so as to be concentric with the polishing table 110 and has an inner shape such as a circular shape. A position guide member 130 guiding the polishing pad 108 to a predetermined position (attachment position) of the polishing table 110 is fitted in the recessed portion 111 from above the polishing table 110 as illustrated by the arrow in FIG. 2.

The position guide member 130 has a cylindrical shape, and the front end side (side opposite to the side fitted in the polishing table 110) is formed in a substantially spherical shape. The position guide member 130 is positioned so as to be concentric with the rotational center of the polishing table 110 (table drive shaft 114).

The position guide member 130 according to the present embodiment is formed assuming that it is fitted in the recessed portion 111, but for example, a screw groove may be formed on each of the outer periphery of the position guide member 130 and the inner periphery of the recessed portion 111 so as to be screwed to each other. Alternatively, instead of providing the recessed portion 111 on the polishing table 110, a screw member may be provided on the upper surface of the polishing table 110 and a screw groove may foe provided inside the position guide member 130 so as to be screwed to each other.

FIG. 3 illustrates a method of positioning the polishing pad 108 for the polishing apparatus 100.

Figure 3A:
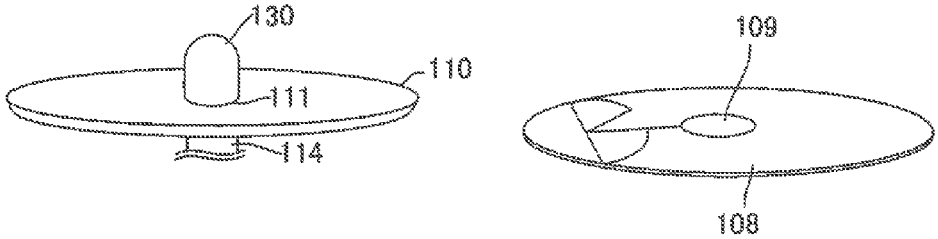
FIG. 3A-3D illustrates a polishing pad positioning method for the polishing apparatus according to the present embodiment.

For example, assuming that the polishing pad 108 needs to be replaced due to weary first, the polishing pad 108 is removed from the polishing table 110 and discarded. Then, as illustrated in FIG. 3A, the position guide member 130 is fitted in the recessed portion 111 of the polishing table 110. Meanwhile, an end of release paper attached to the rear surface of a new polishing pad 108 is peeled off.

Figure 3B:
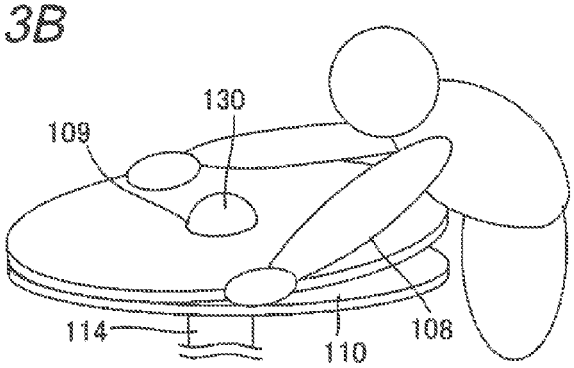

As illustrated in FIG. 3B, as the position guide member 130 is inserted into the guide hole 109 with the attachment surface of the polishing pad 108 downward, the polishing pad 108 is positioned on the polishing table 110. At this time, the polishing pad 108 is guided by the guide hole 109 and the position guide member 130; and the polishing pad 108 is easily positioned (arranged) so as to match the outer periphery thereof with the polishing table 110. Further, the polishing pad 108 is pressed from above the upper surface, whereby an adhesive surface of an end portion of the polishing pad 108 is attached onto the polishing table 110.

Figure 3C:
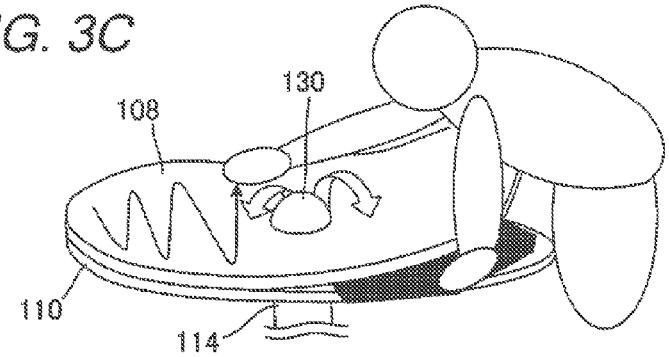

Then, as illustrated in FIG. 3C, as release paper is gradually peeled off from the rear surface of the polishing pad 108, the portion where the release paper is peeled off is attached to the polishing table 110. At this time, in order to prevent air pockets from forming between the rear surface of the polishing pad 108 and the upper surface of the polishing table 110, the polishing pad 108 is pressed against the polishing table 110 starting at an outer edge portion thereof then gradually moving toward a central portion to extrude air pockets for attachment. The polishing pad 108 of the present embodiment has the guide hole 109 formed at the central portion thereof. Thus, when the polishing pad 108 is attached, air between the polishing pad 108 and the polishing table 110 is easily escaped through the guide hole 109, thereby preventing air pockets from forming.

Figure 3D:
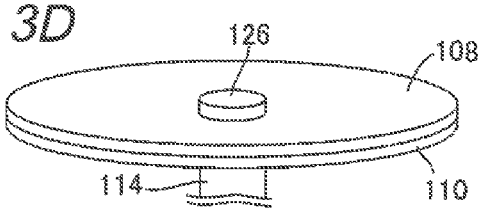

After the entire surface of the polishing pad 108 is attached to the polishing table 110, then as illustrated in FIG. 3D, the position guide member 130 is removed and the lid 126 is fitted in the guide hole 109.

As described above, according to the polishing apparatus and the polishing pad positioning method of the present embodiment, the polishing pad 108 is guided by the guide hole 109 and the position guide member 130, whereby the center of the polishing pad 108 can be easily aligned with the center of the polishing table 110; and thus the polishing pad 108 can be easily positioned on and attached to the polishing table 110 so as to match the outer periphery of the polishing pad 108 with the outer periphery of the polishing table 110. Further, the guide hole 109 is provided in the central portion of the polishing pad 108, and thus air present between the polishing pad 108 and the polishing table 110 can be efficiently extruded from the guide hole 109.

Note that the center of the position guide member 130 described in FIGS. 2 and 3 may not be matched with the rotational center of the polishing table 110. Here specifically, the position guide member 130 may be positioned in a region of the polishing table 110 at least including the rotational center serving as the central portion of the polishing table 110, which can efficiently extrude air from the guide hole 109 of the polishing pad 108 and can exhibit the effect of suppressing air pockets from forming.

Now, another embodiment of the present invention will be described.

Figure 4:
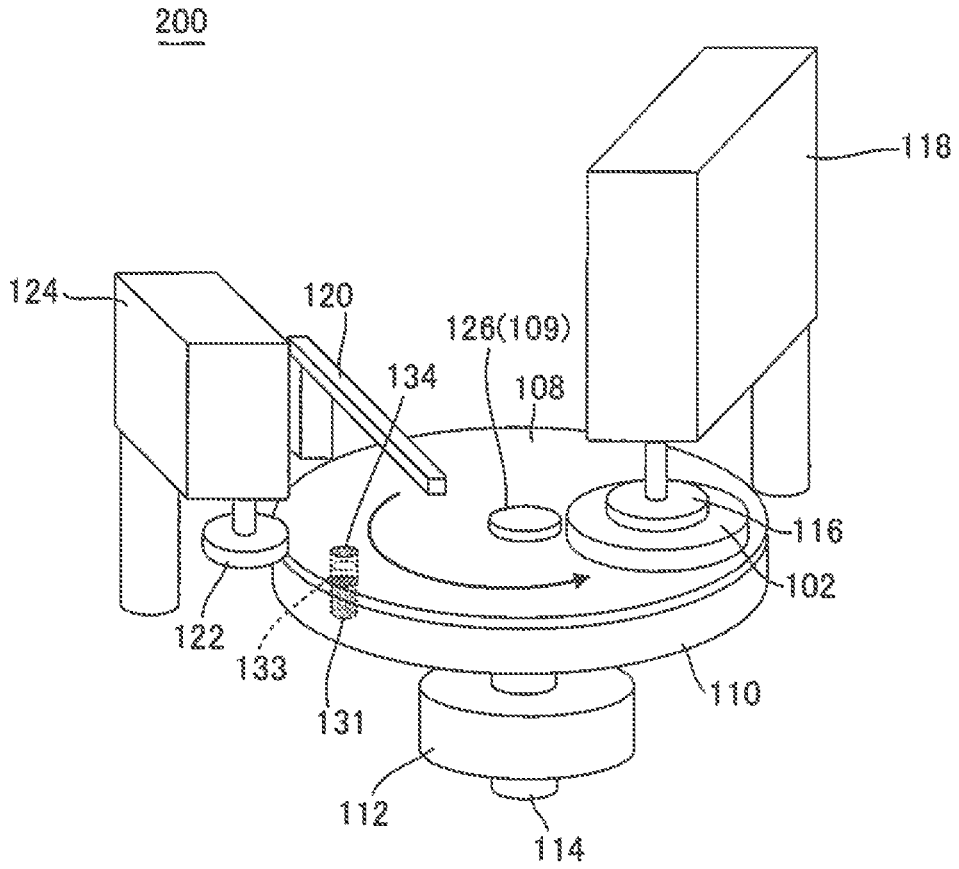
FIG. 4 is a schematic view illustrating an entire configuration of a polishing apparatus according to another embodiment.

FIG. 4 is a schematic view illustrating an entire configuration of a polishing apparatus according to another embodiment of the present invention.

As illustrated in the figure, a polishing apparatus 200 includes a polishing end point detection device 131 which is provided inside the polishing table 110 and optically detects a polishing end point of the substrate 102. The polishing table 110 and the polishing pad 108 include an observation hole 133 and an observation hole 134 respectively for passing light from the polishing end point detection device 131.

For example, the polishing end point detection device 131 includes a light-emitting source and a light receiving source to emit light to a polishing surface of the substrate 102 through the observation hole 133 and the observation hole 134 and then measure and analyze the spectral intensity characteristics of the reflected light thereby to detect an end point of polishing. The polishing end point detection device 131 rotates with the polishing table 110. When positioned directly under the substrate 102, the polishing end point detection device 131 receives the light reflected from the substrate 102 thereby to detect a polished state of the substrate 102.

Figure 5:
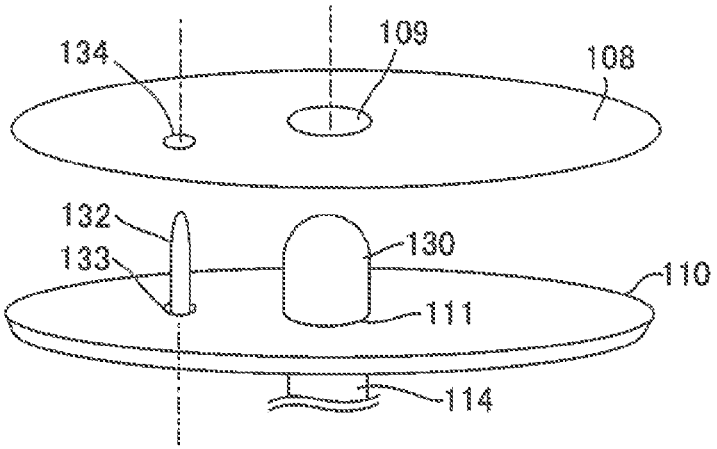
FIG. 5 illustrates a polishing table and a polishing pad of the polishing apparatus illustrated in FIG. 4.

FIG. 5 illustrates the polishing table 110 and the polishing pad 108 of the polishing apparatus 200 illustrated in FIG. 4.

As described above, the polishing apparatus 200 illustrated in FIG. 4 includes the observation hole 133 and the observation hole 134. Thus, when the polishing pad 108 is positioned on the polishing table 110, the outer periphery of the polishing pad 108 needs to be aligned with the outer periphery of the polishing table 110. In addition to the above, the position of the observation hole 134 of the polishing pad 108 needs to be aligned with the position of the observation hole 133 of the polishing table 110. In other words, the direction of positioning the polishing pad 108 needs to be aligned with a desired direction (phase).

In light of this, in the present embodiment, as illustrated in the figure, a direction guide member 132 for guiding the polishing pad 108 to a desired positioning direction is fitted in the observation hole 133 (second attachment portion) of the polishing table 110 from an attachment surface side of the polishing pad 108. The direction guide member 132 is formed, for example, in a bar shape, and the front end side (side opposite to the side fitted in the polishing table 110) is formed in a substantially spherical shape.

When the polishing pad 108 is attached to the polishing table 110, first, as illustrated in the figure, the position guide member 130 is fitted in the recessed portion 111, and the direction guide member 132 is fitted in the observation hole 133. Then, as the position guide member 130 is inserted into the guide hole 109, the direction guide member 132 is inserted into the observation hole 134, whereby the polishing pad 108 is positioned on and attached to the polishing table 110.

Note that before the substrate 102 is polished, the position guide member 130 and the direction guide member 132 are removed from the recessed portion 111 and the observation hole 133 respectively.

According to the polishing apparatus and the polishing pad positioning method of the present embodiment, the polishing pad 108 can be easily positioned on the polishing table 110 by aligning their outer peripheries; and in addition to this, the observation hole 134 of the polishing pad 108 can be easily positioned on the observation hole 133 of the polishing table 110 by aligning their positions, further, the guide hole 109 is provided in the central portion of the polishing pad 108, and thus air present between the polishing pad 108 and the polishing table 110 can be efficiently extruded through the guide hole 109.

Note that the direction guide member 132 is formed assuming that it is fitted in the observation hole 133, but for example, screw grooves each corresponding to the outer periphery of the direction guide member 132 and the inner periphery of the observation hole 133 may be formed so as to be screwed to each other.

Figure 6:
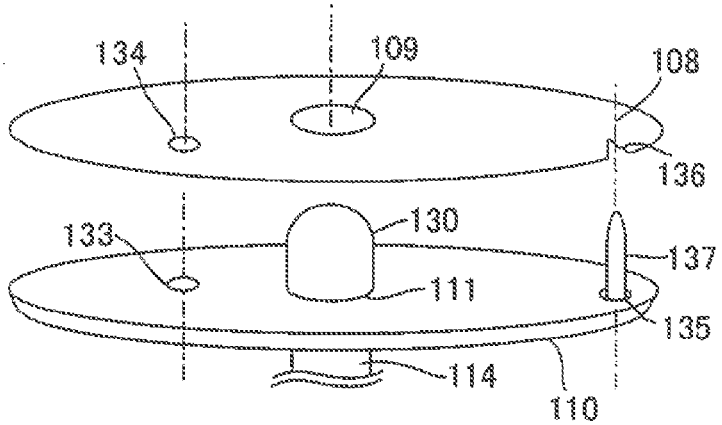
FIG. 6 illustrates a polishing table and a polishing pad of a polishing apparatus according to another embodiment.

FIG. 6 illustrates a polishing table 110 and a polishing pad 108 of a polishing apparatus according to still another embodiment of the present invention.

As illustrated in the figure, the polishing table 110 according to the present embodiment includes an additional direction guide member 137 in an outer peripheral edge of the polishing table 110 instead of the direction guide member 132 illustrated in FIG. 5. A recessed portion 135 (third attachment portion) is formed in the outer peripheral edge of the polishing table 110. The direction guide member 137 is fitted in the recessed portion 135 from an attachment surface side of the polishing pad 108. A notched portion 136 (hole) is formed in an outer periphery portion of the polishing pad 108. In a state in which the outer periphery of the polishing pad 108 is aligned with the outer periphery of the polishing table 110, the notched portion 136 is positioned so that the position of the observation hole 134 is aligned with the position of the observation hole 133 when the direction guide member 137 is passed through the notched portion 136.

Note that the notched portion 136 may have any shape including a hole as long as the direction guide member 137 can be passed therethrough. The notched portion of the present embodiment includes a hole.

When the polishing pad 108 is attached to the polishing table 110, first, as illustrated in the figure, the position guide member 130 is fitted in the recessed portion 111 and the direction guide member 137 as fitted in the recessed portion 135. Then, as the position guide member 130 is inserted into the guide hole 109, their directions are aligned so as to allow the direction guide member 137 to pass through the notched portion 136, and then the polishing pad 108 is positioned on and attached to the polishing table 110.

Notes that when the substrate 102 is polished, the position guide member 130 and the direction guide member 137 are removed from the recessed portion 111 and the recessed portion 135 respectively.

According to the polishing apparatus and the polishing pad positioning method of the present embodiment, the polishing pad 108 can be easily positioned on the polishing table 110 by aligning their outer peripheries; and in addition to this, the observation hole 134 of the polishing pad 108 can be easily positioned on the observation hole 133 of the polishing table 110 by aligning their positions. Further, the guide hole 109 is provided in the central portion of the polishing pad 108, and thus air present between the polishing pad 108 and the polishing table 110 can be efficiently extruded through the guide hole 109.

Note that the direction guide member 137 is formed assuming that it is fitted in the recessed portion 135, but for example, screw grooves each corresponding to the outer periphery of the direction guide member 137 and the inner periphery of the recessed portion 135 may be formed so as to be screwed to each other. Alternatively, instead of providing the recessed portion 135 on the polishing table 110, a screw member may be provided on the upper surface of the polishing table 110 and a screw groove may be provided inside the position guide member 130 so as to be screwed to each other.

Still alternatively, the direction guide member 132 illustrated in FIG. 5 may be provided in the polishing table 110 illustrated in FIG. 6. In this case, a plurality of direction guide members are used, and thus the direction of positioning the polishing pad 108 can be aligned in a desired direction with higher accuracy.

Figure 7:
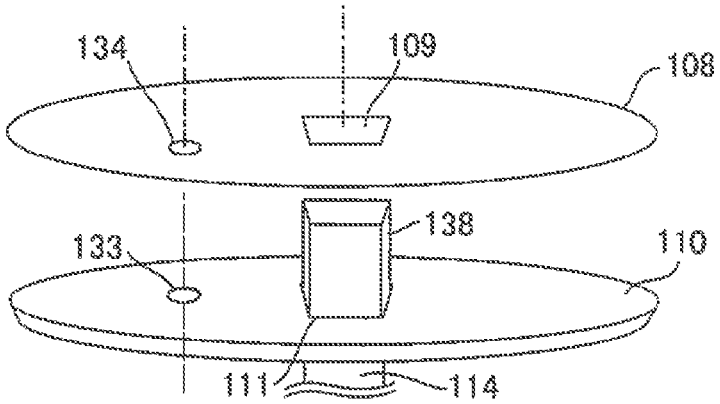
FIG. 7 illustrates a polishing table and a polishing pad of a polishing apparatus according to still another embodiment.

FIG. 7 illustrates a polishing table 110 and a polishing pad 108 of a polishing apparatus according to still another embodiment of the present invention.

As illustrated in the figure, the polishing table 110 according to the present embodiment includes a position guide member 133 having a shape different from that of the position guide member 130 illustrated in FIG. 5. The polishing table 110 includes a recessed portion 111 on a rotational center of the upper surface to which the polishing pad 108 is to be attached. The position guide member 133 for guiding the polishing pad 108 to a desired position of the polishing table 110 is fitted in the recessed portion 111. The position guide member 138 has a trapezoidal outer shape in a plan view in a state of being fitted in the recessed portion 111. A guide hole 109 is formed at the central portion of the polishing pad 108 so as to allow the position guide member 138 to be inserted thereinto. The guide hole 109 is formed into a trapezoidal shape so as to correspond to the shape of the position guide member 138. When the position guide member 138 is inserted into the guide hole 109, rotation in a circumferential direction of the polishing pad 108 around the guide hole 109 is suppressed, that is, the direction of the polishing pad 108 is determined. Note that the direction of the guide hole 109 is formed so as to allow the position of the observation hole 134 to be aligned with the position of the observation hole 133 when polishing pad 108 is positioned on the polishing table 110 by passing the position guide member 138 through the guide hole 109.

When the polishing pad 108 is attached to the polishing table 110, first, as illustrated in the figure, the position guide member 138 is fitted in the recessed portion 111. Then, the direction (phase) of the polishing pad 108 is adjusted so as to allow the position guide member 138 to be inserted into the guide hole 109. Then, the position guide member 138 is inserted into the guide hole 109, whereby the polishing pad 108 is positioned on and attached to the polishing table 110.

According to the polishing apparatus and the polishing pad positioning method of the present embodiment, the polishing pad 108 can be easily positioned on the polishing table 110 by aligning their outer peripheries. Since the position guide member 138 has a trapezoidal outer shape, the direction of the polishing pad 108 is uniquely determined at the same time when the position guide member 138 is inserted into the guide hole 109. Therefore, the position of the observation hole 134 can be easily aligned with the position of the observation hole 133. In other words, the position guide member 138 can also guide the direction of the polishing pad 108. Further, the guide hole 109 is provided in the central portion of the polishing pad 108, and thus air present between the polishing pad 108 and the polishing table 110 can be efficiently extruded through the guide hole 109.

Note that the shape of the position guide member 138 is not limited to a trapezoidal shape, but may be any non-perfect-circular shape such as a regular polygon and an ellipse as long as the shape can suppress rotation in a circumferential direction of the polishing pad 108 around the guide hole 109 by inserting the position guide member 138 into the guide hole 109 of the polishing pad 108, that is, the shape can determine the direction of the polishing pad 108. In this case, of a plurality of directions of the polishing pad 108 allowing the position guide member 138 to be inserted into the guide hole 109, a worker selects a direction allowing the position of the observation hole 134 to be aligned with the position of the observation hole 133 and attaches the polishing pad 108. Meanwhile, any rotationally asymmetric shape such as a trapezoidal shape used in the present invention uniquely determines the direction of the polishing pad 108 allowing the position guide member 138 to be inserted into the guide hole 109, which can simplify the attachment work and thus is more preferable. As used herein, the term "rotationally asymmetric shape" refers to a shape which overlaps with its original shape only when rotated by 360°.

Note that the polishing table 110 of the present embodiment may be combined with the direction guide member 132 illustrated in FIG. 5 and the direction guide member 137 illustrated in FIG. 6. In this case, a plurality of direction guide members are used, and thus the direction of positioning the polishing pad 108 can be aligned in a desired direction with higher accuracy.

Figure 8A:
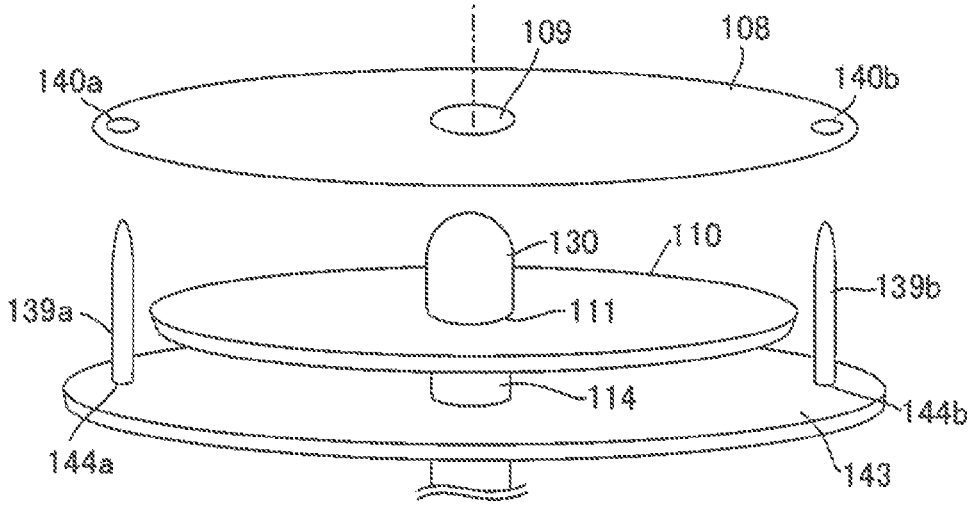
FIG. 8A illustrates a polishing table and a polishing pad of a polishing apparatus according to further another embodiment.
Figure 8B:
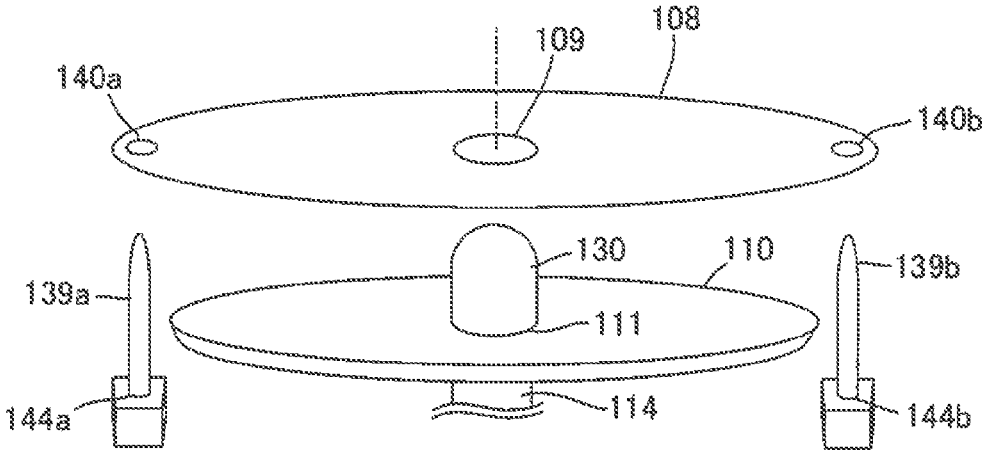
FIG. 8B illustrates a polishing table and a polishing pad of a polishing apparatus according to further another embodiment.

FIGS. 8A and 8B each illustrate a polishing table 110 and a polishing pad 108 of a polishing apparatus according to further another embodiment of the present embodiment.

As illustrated in FIG. 8A, instead of the direction guide member 132 illustrated in FIG. 5 and the direction guide member 137 illustrated in FIG. 6, the polishing table 110 of the present embodiment includes an additional direction guide member 139*a* and a direction guide member 139*b* outside the polishing table 110. The direction guide member 139*a* and the direction guide member 139*b* are configured to protrude from a rear surface side of the polishing table 110 toward a front surface side thereof and are attached to an attachment portion 144*a* and an attachment portion 144*b* (fourth attachment portion) provided on an attachment base 143 rotating coaxially with a table drive shaft 114 by an appropriate method such as fitting and screwing.

Note that according to the present embodiment, the attachment portion 144*a* and the attachment portion 144*b* are provided on the attachment base 143, but, without being limited to this, may be provided so as to rotate coaxially with the table drive shaft 114.

The polishing pad 108 is configured to have a portion protruding from the polishing table 110 when attached to the polishing table 110. The protruding portion includes a hole 140*a* and a hole 140*b* so as to allow the direction guide member 139*a* and the direction guide member 139*b* to pass therethrough respectively. Note that the polishing pad 108 may be configured such that at least a portion including the hole 140*a* and the hole 140*b* protrudes from the polishing table 110.

When the polishing pad 108 is attached to the polishing table 110, first, as illustrated in the figure, the position guide member 130 is fitted in the recessed portion 111; and then the direction guide member 139*a* and the direction guide member 139*b* are attached to the attachment portion 144*a* and the attachment portion 144*b* respectively. Then, as the position guide member 130 is inserted into the guide hole 109, their directions are aligned so as to allow the direction guide member 139*a* and the direction guide member 139*b* to pass through the hole 140*a* and the hole 140*b* respectively, and then the polishing pad 108 is positioned on and attached to the polishing table 110.

Note that when the substrate 102 is polished, the position guide member 130, the direction guide member 139*a*, and the direction guide member 139*b* are removed from the recessed portion 111, the attachment portion 144*a*, and the attachment portion 144*b* respectively.

According to the polishing apparatus and the polishing pad positioning method of the present embodiment, the center of the polishing pad 108 can be easily aligned with the center of the polishing table 110. In addition, the attachment portion 144*a* and the attachment portion 144*b* are provided so as to rotate coaxially with the table drive shaft 114. Therefore, a positional relationship between the polishing table 110 and the attachment portion 144*a* and the attachment portion 144*b* (direction guide member 139*a* and the direction guide member 133*b*) is fixed, and thus the polishing pad 108 can be positioned on the polishing table 110 by accurately aligning their phases. In addition, the guide hole 109 is provided in the central portion of the polishing pad 108, and thus air present between the polishing pad 108 and the polishing table 110 can be efficiently extruded through the guide hole 109. Further, there is no need to provide holes on the polishing surface of the polishing pad 108 so as to pass the direction guide member 139*a* and the direction guide member 139*b* therethrough, and thus there is no effect on the substrate polishing performance.

Notes that the present embodiment provides two direction guide members: the direction guide member 139*a* and the direction guide member 139*b*, but may provide at least one direction guide member. Note also that the direction guide member 132 illustrated in FIG. 5 and the direction guide member 137 illustrated in FIG. 6 may be further provided. In this case, a plurality of direction guide members are used, and thus the direction of positioning the polishing pad 108 can be aligned in a desired direction with higher accuracy.

Instead of the position guide member 130 of the present embodiment, the position guide member 138 illustrated in FIG. 7 may be provided.

Note that the present embodiment does not include the observation hole 133 or the observation hole 134 described in FIGS. 5 to 7, but the observation holes may be provided as needed.

Note that the attachment portion 144*a* and the attachment portion 144*b* according to the present embodiment may be provided in another portion of the polishing apparatus, the portion not rotating coaxially with the table drive shaft 114 as illustrated in FIG. 8B.

Figure 9A:
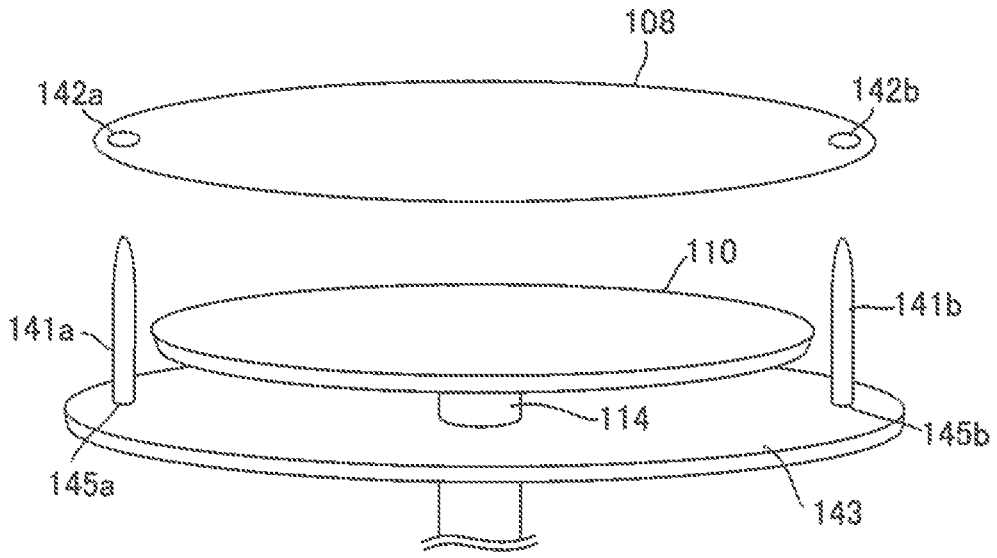
FIG. 9A illustrates a polishing table and a polishing pad of a polishing apparatus according to still further another embodiment.
Figure 9B:
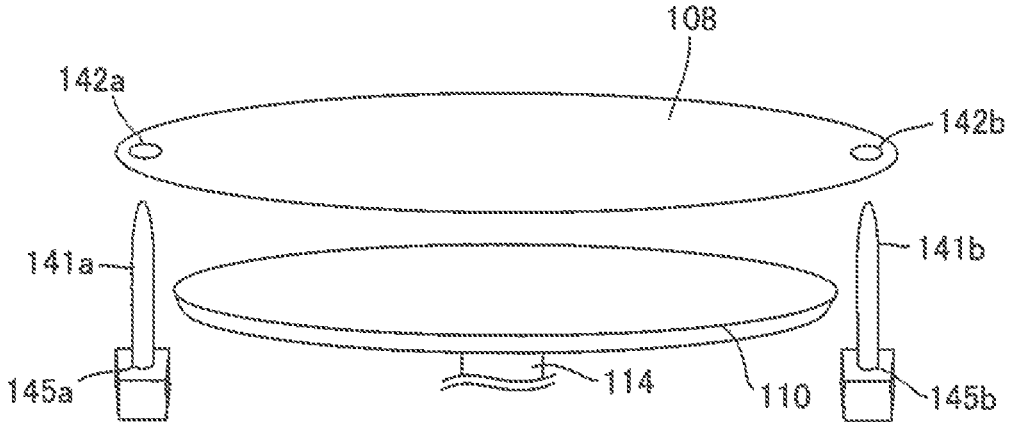
FIG. 9B illustrates a polishing table and a polishing pad of a polishing apparatus according to still further another embodiment.

FIGS. 9A and 9B each illustrate a polishing table 110 and a polishing pad 108 of a polishing apparatus according to further another embodiment of the present embodiment.

As illustrated in FIG. 9A, the polishing table 110 of the present embodiment does not include the position guide member 130 or the recessed portion 111 illustrated in FIGS. 5 to 8. Instead of the direction guide member 132 illustrated in FIG. 5 and the direction guide member 137 illustrated in FIG. 6, an additional direction guide member 141*a* and a direction guide member 141*b* are provided outside the polishing table 110. The direction guide member 141*a* and the direction guide member 141*b* are configured to protrude from a rear surface side of the polishing table 110 toward a front surface side thereof and are attached to an attachment portion 145*a* and an attachment portion 145*b* (fifth attachment portion) provided on an attachment base 143 rotating coaxially with a table drive shaft 114 by an appropriate method such as fitting and screwing.

Note that according to the present embodiment, the attachment portion 145*a* and the attachment portion 145*b* are provided on the attachment base 143, but, without being limited to this, may be provided so as to rotate coaxially with the table drive shaft 114.

The polishing pad 108 is configured to have a portion protruding from the polishing table 110 when attached to the polishing table 110. The protruding portion includes a hole 142*a* and a hole 142*b* so as to allow the direction guide member 141*a* and the direction guide member 141*b* to pass therethrough respectively. Note that the polishing pad 108 may be configured such that at least a portion including the hole 142*a* and the hole 142*b* protrudes from the polishing table 110.

When the polishing pad 108 is attached to the polishing table 110, first, as illustrated in the figure, the direction guide member 141*a* and the direction guide member 141*b* are attached to the attachment portion 145*a* and the attachment portion 145*b* respectively. Then, the directions are aligned so as to allow the direction guide member 141*a* and the direction guide member 141*b* to pass through the hole 142*a* and the hole 142*b* respectively, and then the polishing pad 108 is positioned on and attached to the polishing table 110.

Note that when the substrate 102 is polished, the direction guide member 141*a* and the direction guide member 141*b* are removed from the attachment portion 145*a* and the attachment portion 145*b* respectively.

According to the polishing apparatus and the polishing pad positioning method of the present embodiment, the polishing pad 108 can be easily positioned in a desired position. In addition, the attachment portion 145*a* and the attachment portion 145*b* are provided so as to rotate coaxially with the table drive shaft 114. Therefore, a positional relationship between the polishing table 110 and the attachment portion 145*a* and the attachment portion 145*b* (the direction guide member 141*a* and the direction guide member 141*b*) is fixed, and thus the polishing pad 108 can be positioned on the polishing table 110 by accurately aligning their phases. Further, there is no need to provide holes on the polishing surface of the polishing pad 108 so as to pass the position guide member 130, the direction guide member 141*a*, and the direction guide member 141*b* therethrough, and thus there is no effect on the substrate polishing performance.

Note that the direction guide member 132 illustrated in FIG. 5 and the direction guide member 137 illustrated in FIG. 6 may be further provided. In this case, a plurality of direction guide members are used, and thus the direction of positioning the polishing pad 108 can be aligned in a desired direction with higher accuracy.

Note also that the present embodiment does not include the observation hole 133 or the observation hole 134 described in FIGS. 5 to 7, but the observation holes may be provided as needed.

Note that the attachment portion 145*a* and the attachment portion 145*b* according to the present embodiment may be provided in another portion of the polishing apparatus, the portion not rotating coaxially with the table drive shaft 114 as illustrated in FIG. 9B. In this case, there is no need to process the table drive shaft 114 and the like, and thus the attachment portion 145*a* and the attachment portion 145*b* can be easily provided in the polishing apparatus.

The embodiments of the present invention have been described above, but the present invention is not limited to the above embodiments, and various modifications can be made to the above embodiments within the scope of the technical idea described in the claims, description, and drawings. Note that any shape or material not directly described in the description or drawings falls within the scope of the technical idea of the present invention as long as it exhibits the operation or effect of the present invention.

100 polishing apparatus
102 substrate
103 polishing pad
109 guide hole
110 polishing table
111 recessed portion
112 first electric motor
114 table drive shaft
116 substrate
118 second electric motor
120 slurry line
122 dresser disk
124 dresser unit
126 lid
130 position guide member
131 polishing end point detection device
132 direction guide member
133 observation hole
134 observation hole
135 recessed portion
135 notched portion
137 direction guide member
138 position guide member
139*a* direction guide member
139*b* direction guide member
140*a* hole
140*b* hole
141*a* direction guide member
141*b* direction guide member
142*a* hole
142*b* hole
143 attachment base
144*a* attachment portion
144*b* attachment portion
145*a* attachment portion
145*b* attachment portion

What is claimed is:

1. A polishing apparatus comprising: a motor; and a rotatable polishing table coupled to the motor, the rotatable polishing table having a surface on which a polishing pad for polishing a substrate can be positioned, the polishing table having a first guide formed therein configured to removably receive a position guide member, wherein the position guide member guiding the polishing pad to a predetermined position on the polishing table, the first guide formed at a rotational center of the surface of the polishing table, the position guide member is configured to be inserted into the first guide and a hole having a non-perfect-circular shape provided in the polishing pad when the polishing pad is positioned, wherein the position guide member has a shape substantially similar to the shape of the hole in plan view in a state of being attached to the first guide.

2. The polishing apparatus according to claim 1, wherein the polishing table includes a third guide for attaching a direction guide member guiding a direction of positioning the polishing pad, and the third guide is provided on an outer peripheral edge of the polishing table.

3. The polishing apparatus according to claim 1, wherein the position guide member has a rotationally asymmetric outer shape in plan view in a state of being attached to the first guide.

4. The polishing apparatus according to claim 1, further comprising a fourth guide for attaching a direction guide member guiding a direction of positioning the polishing pad, wherein the polishing pad is configured to have a portion protruding from the polishing table when placed on the polishing table, and the direction guide member attached to the fourth guide is configured to be positioned in a position corresponding to the protruding portion of the polishing pad.

5. A polishing apparatus according to claim 1, further including:

at least one fifth attachment portion for attaching a plurality of direction guide members guiding a direction of positioning the polishing pad, wherein the polishing pad is configured to have a portion protruding from the polishing table when placed on the polishing table, the plurality of direction guide members attached to the at least one fifth attachment portion are configured to be positioned at positions each corresponding to the protruding portion of the polishing pad, the at least one fifth attachment portion is arranged outside the polishing table, the plurality of direction guide members are configured to be inserted into holes arranged on the portion protruding from the polishing table, and the plurality of direction guide members are removable from the at least one fifth attachment portion in a state in which the polishing pad is attached to the polishing table.

6. A polishing apparatus comprising a rotatable polishing table having a surface on which a polishing pad for polishing a substrate can be positioned, wherein the polishing table has a first attachment portion configured to allow a position guide member guiding the polishing pad to a predetermined position of the polishing table to be attached thereto, the first attachment portion is formed at a rotational center of the surface of the polishing table, the position guide member is configured to be inserted into a hole having a non-perfect-circular shape provided in the polishing pad when the polishing pad is positioned, and a top surface of the position guide member having a shape substantially similar to the shape of the hole.

7. A polishing apparatus comprising a rotatable polishing table having a surface on which a polishing pad for polishing a substrate can be positioned, wherein the polishing table has a first attachment portion configured to allow a position guide member guiding the polishing pad to a predetermined position of the polishing table to be attached thereto, the first attachment portion is formed at an offset from a rotational center of the surface of the polishing table, the position guide member is configured to be inserted into a hole having a non-perfect-circular shape provided in the polishing pad when the polishing pad is positioned and extending through the polishing pad such that the position guide member extends above a top surface of the polishing pad, wherein the position guide member has a shape substantially similar to the shape of the hole in plan view in a state of being attached to the first guide.

8. A polishing apparatus according to claim 1, comprising:

a motor;

a rotatable polishing table coupled to the motor, the rotatable polishing table having a surface on which a polishing pad for polishing a substrate can be positioned, the polishing table having a first guide formed therein configured to removably receive a position guide member, wherein the position guide member guiding the polishing pad to a predetermined position on the polishing table, the first guide formed at a rotational center of the surface of the polishing table, the position guide member is configured to be inserted into the first guide and a hole provided in the polishing pad when the polishing pad is positioned, the polishing table includes a second guide for attaching a direction guide member guiding a direction of positioning the polishing pad, and the second guide includes a hole for passing light emitted from a polishing end point detection device detecting a polishing end point of the substrate being polished.

9. The polishing apparatus according to claim 8, wherein the position guide member has a non-perfect-circular outer shape in plain view in a state of being attached to the first guide.

10. The polishing apparatus according to claim 9, wherein the position guide member has a rotationally asymmetric outer shape in plain view in a state of being attached to the first attachment portion.

11. The polishing apparatus according to claim 8, further comprising a fourth attachment portion for attaching a direction guide member guiding a direction of positioning the polishing pad, wherein the polishing pad is configured to have a portion protruding from the polishing table when placed on the polishing table, and the direction guide member attached to the fourth attachment portion is configured to be positioned in a position corresponding to the protruding portion of the polishing pad.

12. A polishing apparatus comprising:

a rotatable polishing table having a surface on which a polishing pad for polishing a substrate can be positioned, the polishing table includes a second attachment portion for attaching a direction guide member guiding a direction of positioning the polishing pad, and the second attachment portion includes a hole for passing light emitted from a polishing end point detection device detecting a polishing end point of the substrate being polished.

13. A method of aligning a polishing pad on a polishing table of a polishing apparatus, wherein the polishing table has a first attachment portion configured to allow a position guide member guiding the polishing pad to a predetermined position of the polishing table to be attached thereto, and the first attachment portion is formed at a rotational center of a surface of the polishing table, comprising:

attaching the position guide member to the first attachment portion;

positioning the polishing pad having a hole corresponding to the position guide member on the polishing table by inserting the position guide member into the hole;

attaching the polishing pad to the polishing table in proper alignment; and removing the position guide member from the polishing table after the polishing pad is attached to the polishing table and before rotating the polishing table and processing the substrate by using said polishing pad attached to the polishing table.

* * * * *